US006851935B2

(12) United States Patent
Merrill et al.

(10) Patent No.: US 6,851,935 B2
(45) Date of Patent: Feb. 8, 2005

(54) ABOVE THE MOTOR BELLOWS EXPANSION MEMBER FOR A SUBMERSIBLE PUMP

(75) Inventors: Daniel A. Merrill, Claremore, OK (US); Leslie C. Reid, Coweta, OK (US)

(73) Assignee: Baker Hughes Incorporated, Houston, TX (US)

( * ) Notice: Subject to any disclaimer, the term of this patent is extended or adjusted under 35 U.S.C. 154(b) by 24 days.

(21) Appl. No.: 10/350,788

(22) Filed: Jan. 23, 2003

(65) Prior Publication Data

US 2004/0146415 A1 Jul. 29, 2004

(51) Int. Cl.[7] ..... F04B 35/04

(52) U.S. Cl. ..... 417/53; 417/423.3; 417/423.11; 277/336

(58) Field of Search ..... 417/414, 472, 417/428, 423.3, 423.8, 540, 53, 423.11; 277/336

(56) References Cited

U.S. PATENT DOCUMENTS

| | | | | | |
|---|---|---|---|---|---|
| 2,423,436 | A | | 7/1947 | Blom | 103/87 |
| 3,947,709 | A | * | 3/1976 | Waltman | 310/87 |
| 4,406,462 | A | | 9/1983 | Witten | 277/93 SD |
| 4,421,999 | A | * | 12/1983 | Beavers et al. | 310/87 |
| 4,436,488 | A | | 3/1984 | Witten | 417/53 |
| 4,992,689 | A | | 2/1991 | Bookout | 310/87 |
| 5,622,222 | A | | 4/1997 | Wilson et al. | 166/105.4 |
| 6,059,539 | A | * | 5/2000 | Nyilas et al. | 417/228 |
| 6,242,829 | B1 | * | 6/2001 | Scarsdale | 310/87 |
| 6,307,290 | B1 | | 10/2001 | Scarsdale | 310/87 |
| 6,688,860 | B2 | * | 2/2004 | Du et al. | 417/423.11 |
| 2002/0192090 | A1 | | 12/2002 | Du et al. | 417/423.11 |

FOREIGN PATENT DOCUMENTS

| | | | |
|---|---|---|---|
| CN | 1080366 A | 1/1994 | F04D/13/08 |
| GB | 2336474 A | 10/1999 | F04D/13/08 |

OTHER PUBLICATIONS

Search Report dated Dec. 20, 2002 from UK Patent Office; Prepared in connection with corresponding GB 0213302.3.

* cited by examiner

*Primary Examiner*—Charles G. Freay
(74) *Attorney, Agent, or Firm*—Fellers, Snider, Blankenship, Bailey & Tippens, P.C.

(57) ABSTRACT

A multi-diameter bellows is provided in a seal section of a submersible pump to assist in allowing expansion of dielectric oil within the submersible pump, to equalize the casing annulus pressure with the internal dielectric motor fluid and to isolate the well fluid from the clean dielectric motor fluid. A shaft communicates the motor with the pump and runs through a bellows located in a bellows chamber in the seal section. The bellows is made of a first collapsible section and a second collapsible section. The first collapsible section has a fixed end at a first end of the bellows and has a first cross-sectional area. The second collapsible section has a fixed end at a second end of the bellows and has a second cross-sectional area. A first coupling member is provided between the first collapsible section and the second collapsible section. A volume within the bellows is varied by movement of the first coupling member towards either of the first end and the second end. An additional embodiment has greater than two collapsible sections, wherein each section is separated by a coupling member. In both embodiments, the ends of the bellows are fixed and the volume within the bellows is varied by movement of the coupling member or coupling members, to compress or expand larger or smaller diameter sections to increase or decrease the volume of the bellows as required.

18 Claims, 5 Drawing Sheets

FROM FIG. 1A

ABOVE THE MOTOR BELLOWS EXPANSION MEMBER FOR A SUBMERSIBLE PUMP

BACKGROUND OF THE INVENTION

1. Field of the Invention

This invention relates generally to a seal section for an electrical submersible pump. More particularly, the invention relates to a bellows in a seal section of an electrical submersible pump.

2. Background

Electrical submersible pumps (ESPs) have been used to lift fluid from bore holes, particularly for oil production. In operation, a pump of an electrical submersible pump is placed below the fluid level in the bore hole. The well fluid often contains corrosive compounds such as brine water, $CO_2$, and $H_2S$ that can shorten the run life of an ESP when the ESP is submerged in the well fluid. Corrosion resistant units have been developed that have motors that utilize seals and barriers to exclude the corrosive agents from the internal mechanisms of the ESP.

A typical submersible pump has a motor, a pump above the motor, and a seal section between the motor and the pump. The seal section allows for expansion of the dielectric oil contained in the rotor gap of the motor. Temperature gradients resulting from an ambient and motor temperature rise cause the dielectric oil to expand. The expansion of the oil is accommodated by the seal section. Additionally, the seal section is provided to equalize the casing annulus pressure with the internal dielectric motor fluid. The equalization of pressure across the motor helps keep well fluid from leaking past sealed joints in the motor. It is important to keep well fluids away from the motor because well fluid that gets into the motor will cause early dielectric failure. Measures commonly employed to prevent well fluids from getting into the motor include the use of elastomeric bladders as well as labyrinth style chambers to isolate the well fluid from the clean dielectric motor fluid. Multiple mechanical shaft seals keep the well fluid from leaking down the shaft. The elastomeric bladder provides a positive barrier to the well fluid. The labyrinth chambers provide fluid separation based on the difference in densities between well fluid and motor oil. Any well fluid that gets past the upper shaft seals or the top chamber is contained in the lower labyrinth chambers as a secondary protection means.

One problem with the use of an elastomeric bladder is that, in high temperature applications, elastomeric bladders may experience a short usable life or may not be suitable for use. Elastomeric materials having a higher temperature tolerance tend to be very expensive. An alternative is to replace the elastomeric bladder with a bellows made of metal or another material that may expand as necessary, but which is suitable for use in high temperature applications, and/or which provide improved reliability over an elastomeric bladder.

Bellows have been used previously in submersible pump applications and other pumping systems. For example, the use of bellows is taught in U.S. Pat. Nos. 2,423,436, 6,059,539, and 6,242,829. Previous use of bellows in an ESP has required that the bellows be placed in an awkward configuration, e.g., as taught in U.S. Pat. No. 2,423,436, or that the bellows be located below the motor in an ESP to avoid interfering with a shaft that traverses the length of the ESP to deliver power from the motor to the pump.

It is desirable to be able to use a bellows to replace an elastomeric expansion bag, and that the bellows be configured in a similar manner to the more commonly used elastomeric expansion bag.

SUMMARY OF THE INVENTION

According to the present invention there is provided an improvement in a positive barrier to well fluid in a submersible pump, wherein the barrier is suitable for high temperature applications.

A multi-diameter bellows provides a positive barrier to well fluids. The multi-diameter bellows is preferably located in a seal section to assist in allowing expansion of the dielectric oil, to equalize the casing annulus pressure with the internal dielectric motor fluid and to isolate the well fluid from the clean dielectric motor fluid. The multi-diameter bellows of the invention may be made from materials that are less expensive and are suitable for higher temperatures than an elastomeric bag.

The multi-diameter bellows of the invention is preferably located in a bellows chamber of a seal section of an electrical submersible pump, wherein the seal section is located between a pump and a motor. The bellows chamber has a first end and a second end. A shaft communicates the motor with the pump, and runs through the bellows chamber in the seal section. The bellows is located in the bellows chamber and surrounds the shaft. The bellows is made of a first collapsible section and a second collapsible section. The first collapsible section communicates with the first end of the bellows chamber. The first collapsible section has a first cross-sectional area, e.g., a relatively large diameter. The second collapsible section communicates with the second end of the bellows chamber. The second collapsible section has a second cross-sectional area, e.g., a relatively small diameter. A first coupling member, e.g., a coupling ring, is provided between the first collapsible section and the second collapsible section and also surrounds said shaft. A volume within the bellows is varied by movement of the first coupling member towards either of the first end and the second end.

In a second embodiment of the bellows of the invention, a large diameter section is attached to the bellows chamber at a first end. A second end of the large diameter section has a coupling member thereon, which transitions the bellows from the first large diameter section to a small diameter section. On the other end of the small diameter section, a second coupling member is provided to transition the small diameter section to a second large diameter section, which is affixed to the other end of the bellows chamber. In both embodiments, the ends of the bellows are fixed. The volume within the bellows is varied by movement of the coupling member or coupling members. For example, to increase the volume of the bellows, the coupling member or coupling members are displaced to minimize the volume of the small diameter section and to maximize the volume of the large diameter sections. Conversely, to decrease the volume of the bellows, the coupling members are displaced to maximize the volume of the small diameter section and to minimize the volume of the large diameter section. One advantage of the second bellows embodiment is that the bellows is still partially functional even if one of the coupling members becomes stuck, thereby increasing reliability of the seal section.

A better understanding of the present invention, its several aspects, and its advantages will become apparent to those skilled in the art from the following detailed description, taken in conjunction with the attached drawings, wherein there is shown and described the preferred embodiment of the invention, simply by way of illustration of the best mode contemplated for carrying out the invention.

DETAILED DESCRIPTION OF THE PREFERRED EMBODIMENT

Before explaining the present invention in detail, it is important to understand that the invention is not limited in its application to the details of the embodiments and steps described herein. The invention is capable of other embodiments and of being practiced or carried out in a variety of ways. It is to be understood that the phraseology and terminology employed herein is for the purpose of description and not of limitation.

Figure 1A:
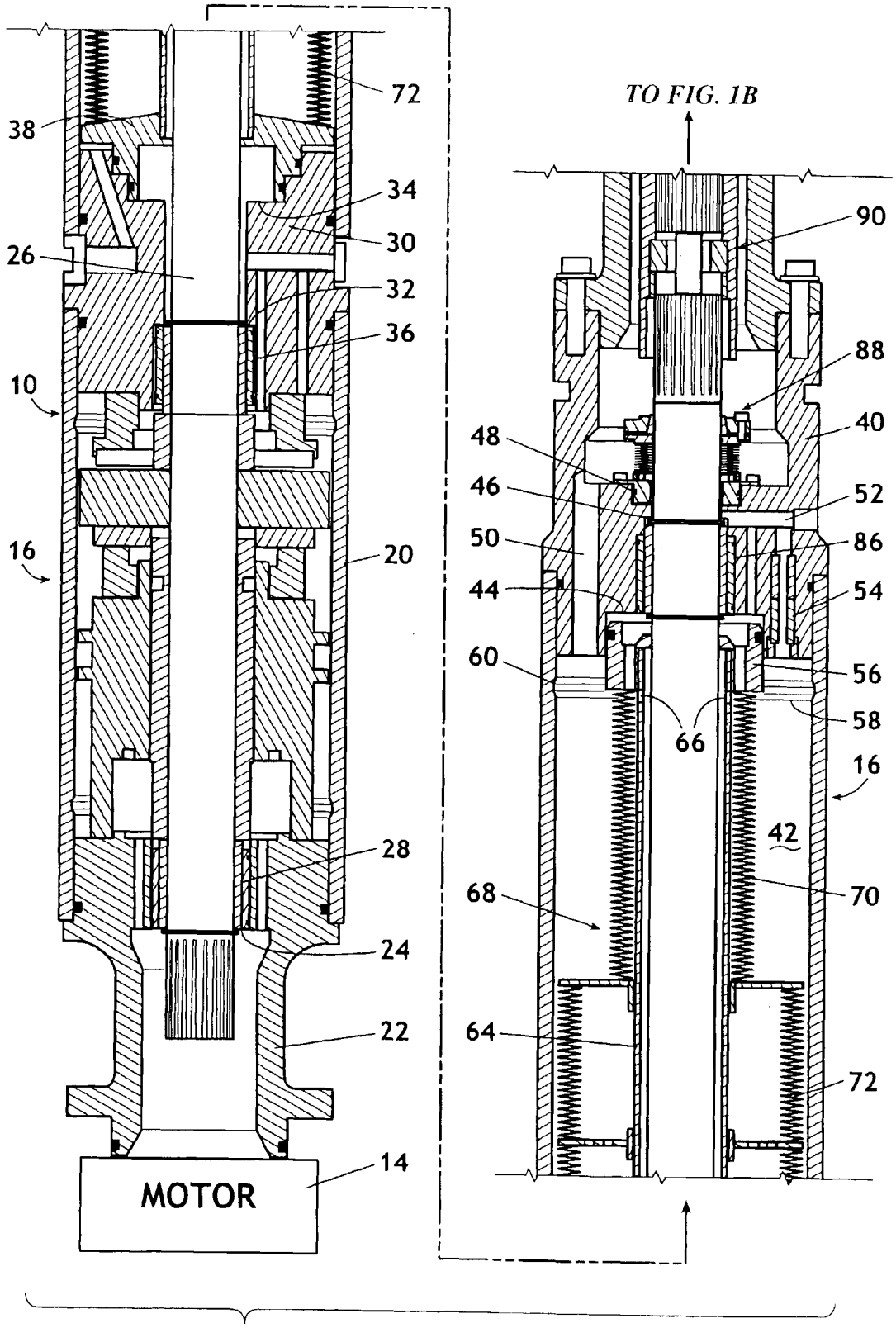
FIG. 1A is a cross-sectional view of a lower section seal section for an electrical submersible pump having a first embodiment of a multi-diameter metal bellows.
Figure 1B:
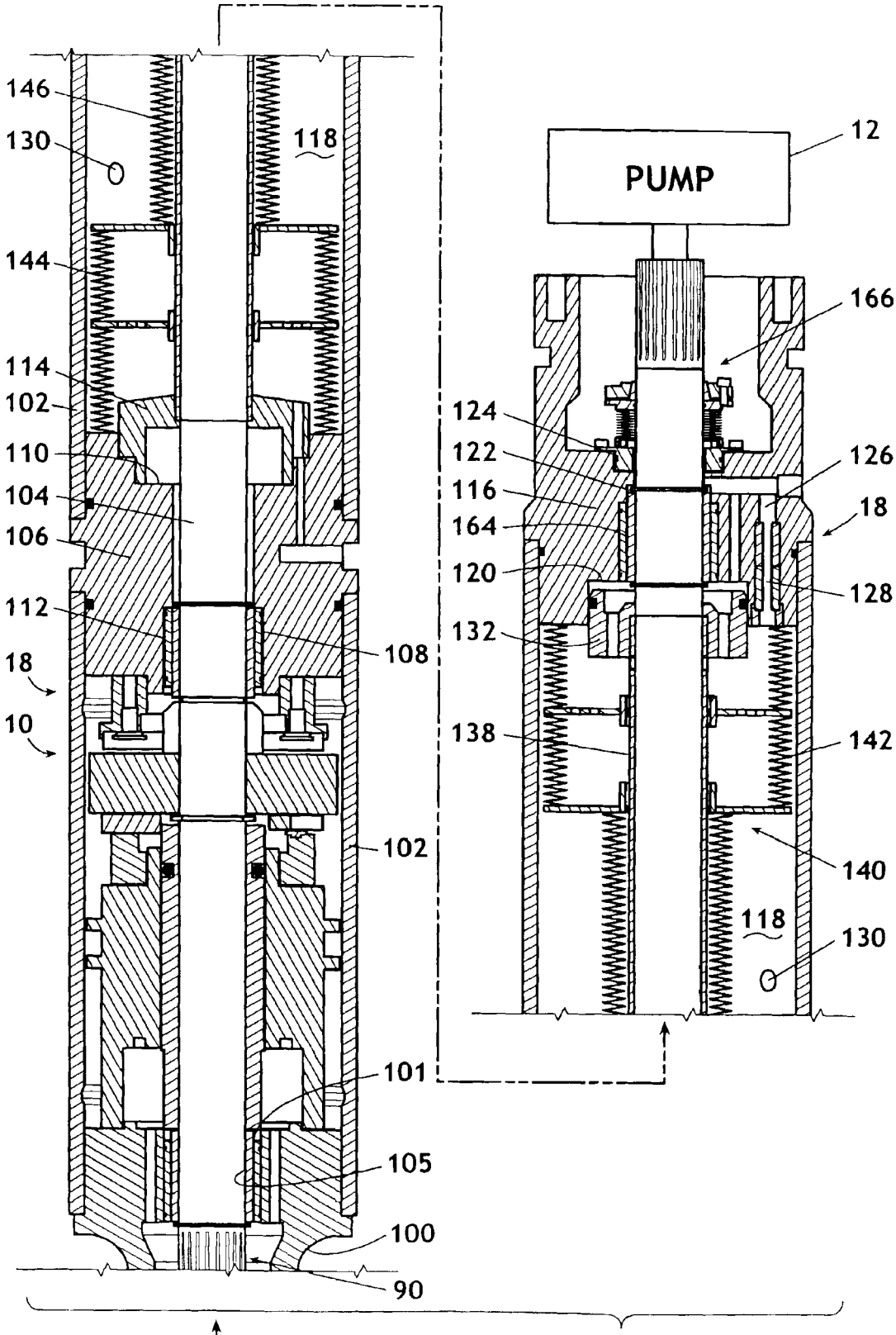
FIG. 1B is a cross-sectional view of an upper section of a seal section for an electrical submersible pump having a second embodiment of multi-diameter metal bellows.

Referring now to FIGS. 1A and 1B, shown is a typical submersible pump configuration wherein a seal section 10 is located between a pump section 12 and a motor section 14. Seal section 10 is made up of a lower seal section 16 (FIG. 1A) and an upper seal section 18 (FIG. 1B). Referring now in particular to FIG. 1A, lower seal section 16 has a housing 20. A base 22 is located in a lower end of a housing 20. Base 22 defines a sleeve receptacle 24. A lower shaft 26 is located within housing 20. A first sleeve 28 surrounds lower shaft 26 and is located in sleeve receptacle 24 of base 22. Lower sleeve block 30 is at least partially located within housing 20. Lower sleeve block 30 defines a sleeve receptacle 32 on a lower end and a collar receptacle 34 on an upper end. A second sleeve 36 is located within the sleeve receptacle 32 of lower sleeve block 30.

A lower guide tube collar 38 is located within collar receptacle 34 of lower sleeve block 30. A lower head 40 is at least partially located within housing 20 and is located above lower sleeve block 30. Lower head 40, housing 20 and lower sleeve block 30 define a lower bellows chamber 42. Lower head 40 defines a ring receptacle 44 on a lower end and a sleeve receptacle 46 above ring receptacle 44. Lower head 40 also defines a lower shaft seal receptacle 48 on an upper end. Fluid bypass conduit 50 and fluid passageway 52 are also defined by the lower head 40. Fluid passageway 52 communicates with an annular space that surrounds lower shaft 26 and also with lower bellows chamber 42. A check valve 54 is provided in fluid passageway 52 to prevent fluid from passing from the lower bellows chamber 42 back into fluid passageway 52.

A guide tube ring 56 is located within ring receptacle 44. A ring retainer collar 58 is threadably received on a guide tube ring 56. Ring retainer collar 58 is preferably provided with a ridge 60 for engaging an inside surface of housing 20. A lower guide tube 64 is located inside lower bellows chamber 42. Lower guide tube 64 is attached at a first end to the guide tube ring 56 and at a second end to lower guide tube collar 38 and surrounds lower shaft 26. Lower guide tube 64 is preferably provided with orifices 66 proximate an upper end up the lower guide tube 64. A first embodiment of a multi-diameter bellows 68 surrounds lower guide tube 64. Multi-diameter bellows 68 has a small diameter portion 70 and a large diameter portion 72. Bellows 68 may be made of metal or other high temperature resistant materials or other suitable materials as desired.

Figure 2A:
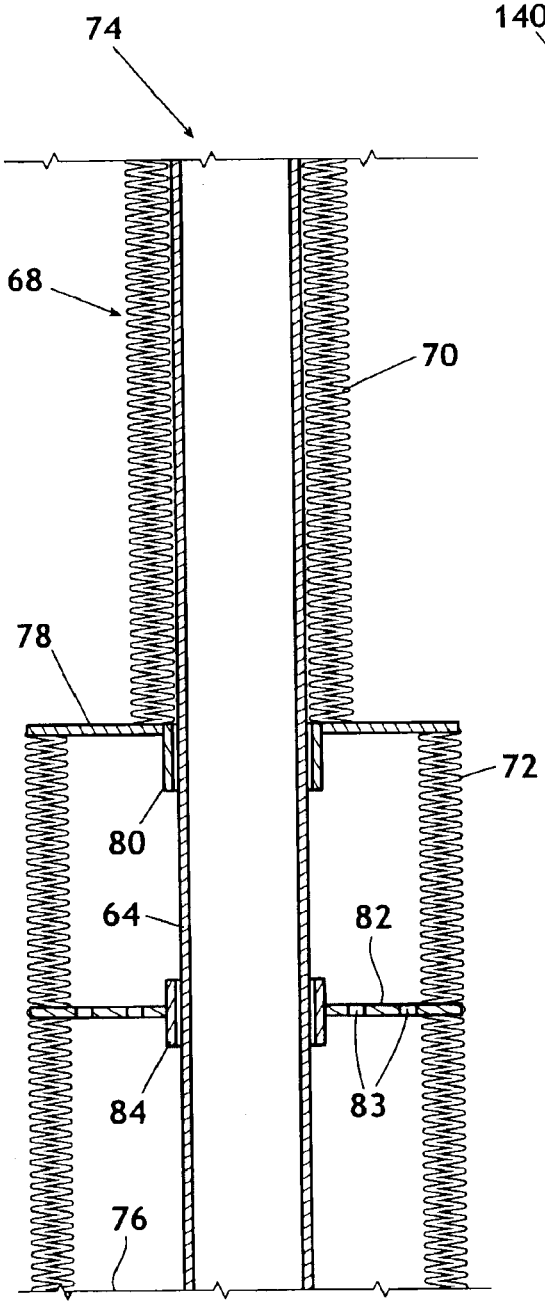
FIG. 2A is a schematic diagram of the first embodiment of the multi-diameter bellows of FIG. 1A shown in a neutral position.
Figure 2B:
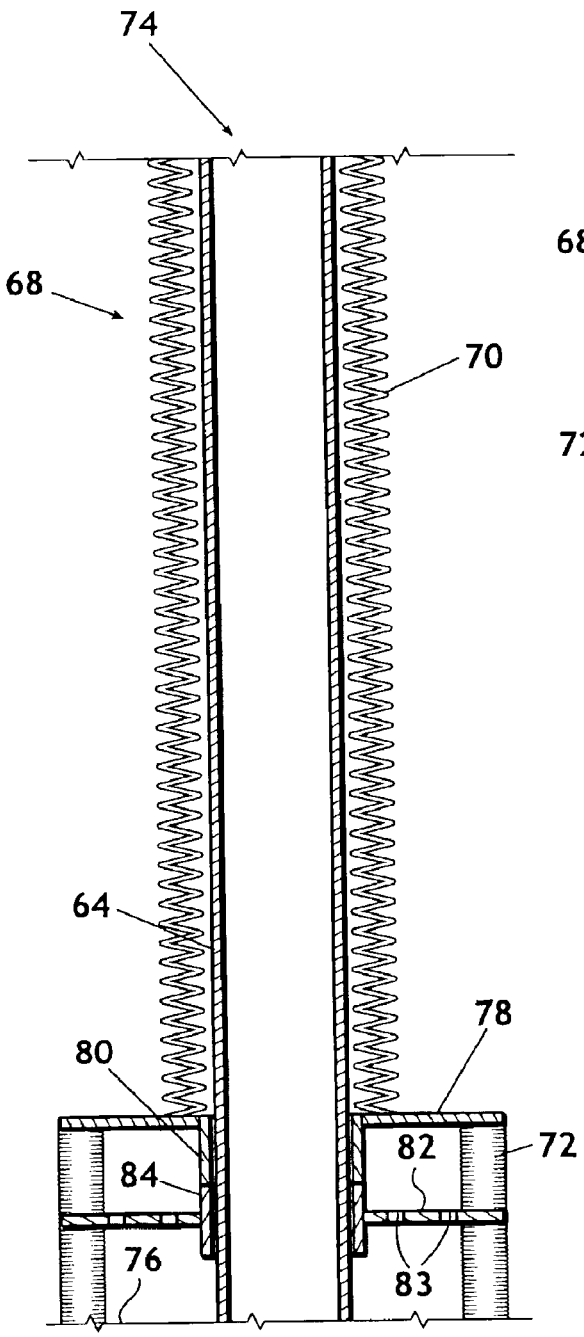
FIG. 2B is a schematic diagram of the first embodiment of the multi-diameter bellows shown in FIG. 1A shown in a fully collapsed or minimum volume configuration.
Figure 2C:
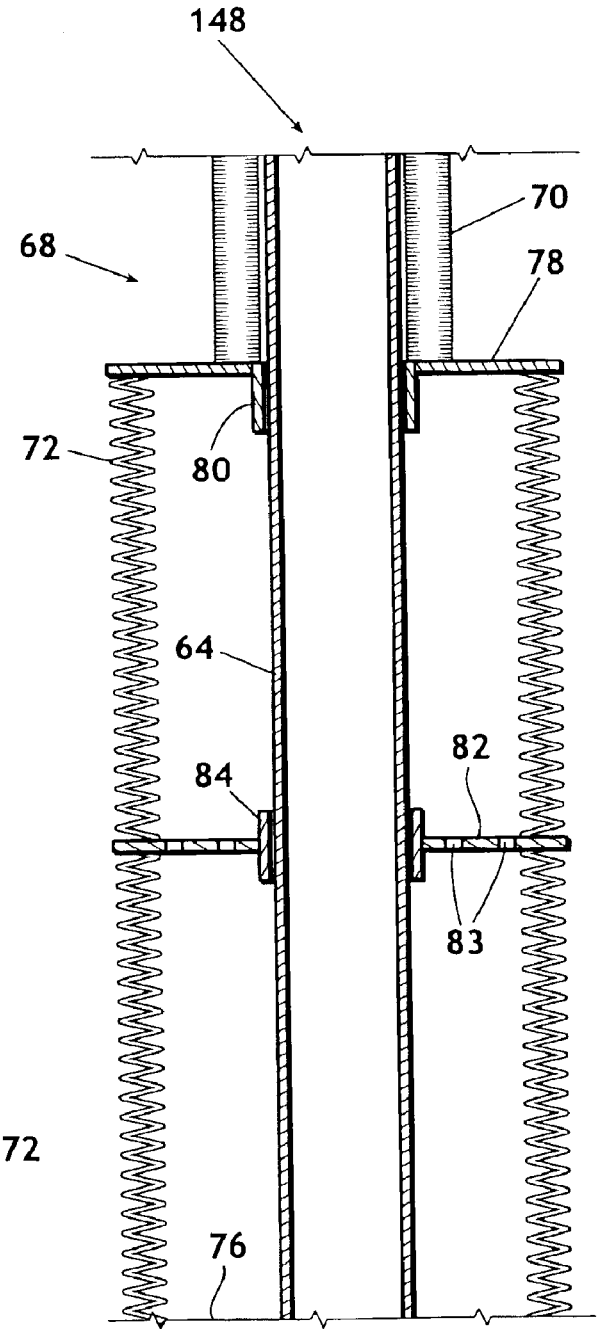
FIG. 2C is a schematic diagram of the first embodiment of the metal bellows of FIG. 1A shown in a completely expanded or maximum volume configuration.

Referring now to FIGS. 2A–2C, the multi-diameter bellows 68 can be seen in greater detail. Small diameter portion 70 has an upper end 74 affixed to ring retainer collar 58. Large diameter portion 72 has a lower end 76 affixed to lower guide tube collar 38. Small diameter portion 70 is separated from large diameter portion 72 by a coupling ring 78. Coupling ring 78 is attached to an upper end of large diameter portion 72 and to lower end of small diameter portion 70. Coupling ring 78 is preferably provided with a runner 80 for slidably engaging the lower guide tube 64. Multi-diameter bellows 68 is also preferably provided with at least one stabilizer disk 82 that is also provided with a runner 84 on an inner diameter of the stabilizer disk 82 for slidably engaging lower guide tube 64. Stabilizer disk 82 also communicates with an outer diameter of large diameter portion 72. Stabilizer disk 82 preferably has a first side attached to a segment of a large diameter portion 70 and has a second side attached to a separate segment of large diameter portion 72. Stabilizer disk 82 is preferably provided with orifices 83 formed therein for permitting fluid to pass therethrough within the multi-diameter bellows 68.

Referring back to FIG. 1A, a third sleeve 86 is located in the sleeve receptacle 46 of lower head 40. A lower shaft seal 88 is located partially in the lower shaft seal receptacle 48 of lower head 40. Lower shaft seal 88 is provided to prevent fluid migration along lower shaft 26. A coupling 90 is provided on an upper end of lower shaft 26.

Referring now to FIG. 1B, upper seal section 18 has an upper base 100 affixed to an upper end of lower head 40. An upper housing 102 has a lower end has is affixed to upper base 100. Upper base 100 has a sleeve receptacle 101 formed in an upper end. An upper shaft 104 passes through upper housing 102. Upper shaft 104 has a lower end that engages coupling 90. A fourth sleeve 105 is located in sleeve receptacle 101. Upper sleeve block 106 is at least partially located within upper housing 102. Upper sleeve block 106 defines a sleeve receptacle 108 at a lower end thereof and a collar receptacle 110 on an upper end. A fifth sleeve 112 is located within sleeve receptacle 108. A lower guide tube collar 114 is located within collar receptacle 110. Upper head 116 is at least partially located within upper housing 102 and above upper sleeve block 106. The upper head 116, the upper housing 102 and the upper sleeve block 106 define an upper bellows chamber 118. The upper head 116 defines a ring receptacle 120 on a lower end and a sleeve receptacle 122 above ring receptacle 120. Additionally, upper head 116 defines an upper shaft seal receptacle 124 on an upper end. Upper head 116 additionally defines a fluid passageway 126 that communicates an annular space around upper shaft 104 with the upper bellows chamber 118. A check valve 128 is provided for allowing fluid to pass from fluid passageway 126 to the upper bellows chamber 118. The portion of upper housing 102 that defines the upper bellows chamber 118 is provided with perforations 130 to allow well fluids to migrate into the upper bellows chamber 118 to equalize pressure between the upper bellows chamber 118 and the wellbore.

An upper guide tube ring 132 is located within ring receptacle 120. An upper guide tube 138 is attached to the lower guide tube collar 114 on a lower end and is attached to the upper guide tube ring 132 at an upper end. A second embodiment of a multi-diameter bellows 140 surrounds the upper guide tube 138. Multi-diameter bellows 140 has a first large diameter portion 142, a second large diameter portion 144, and a small diameter portion 146. Bellows 140 may be made of metal or other high temperature resistant materials or other suitable materials as desired.

Figure 3A:
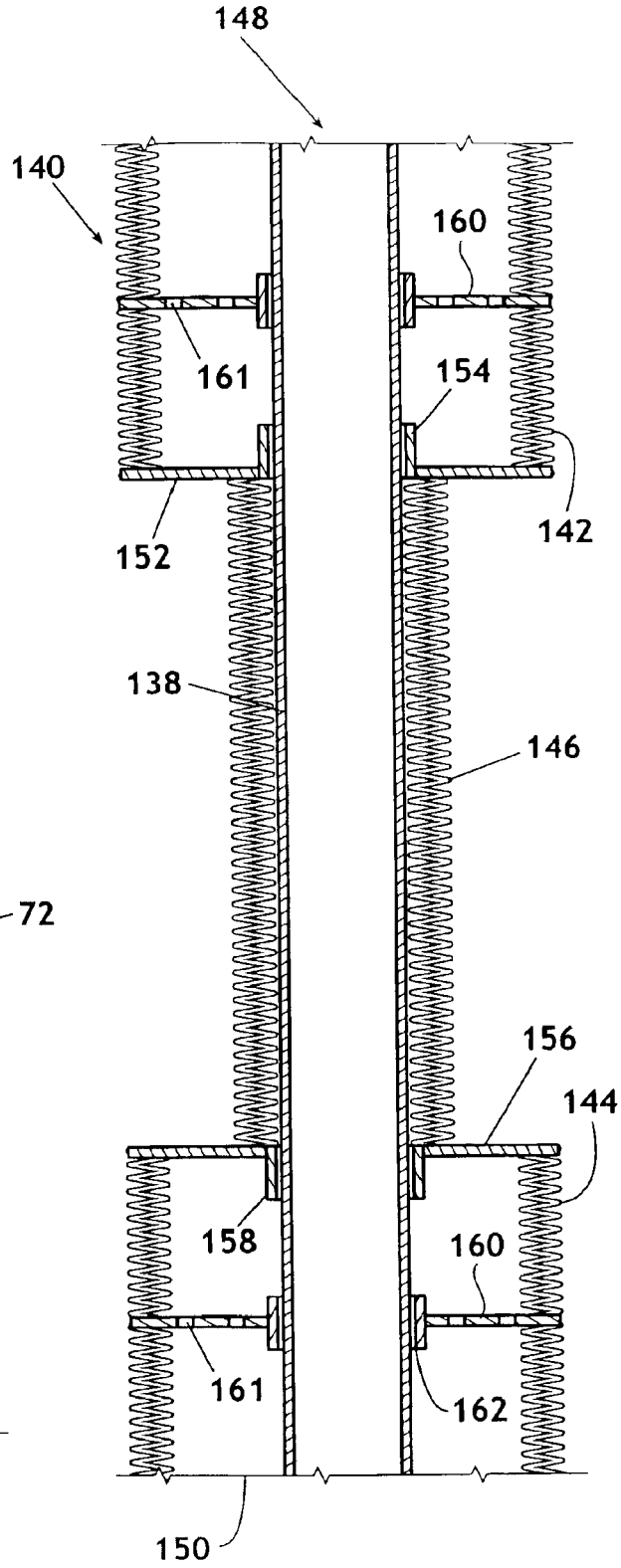
FIG. 3A is a schematic diagram of the second embodiment of the multi-diameter bellows shown in FIG. 1B shown in a neutral position.
Figure 3B:
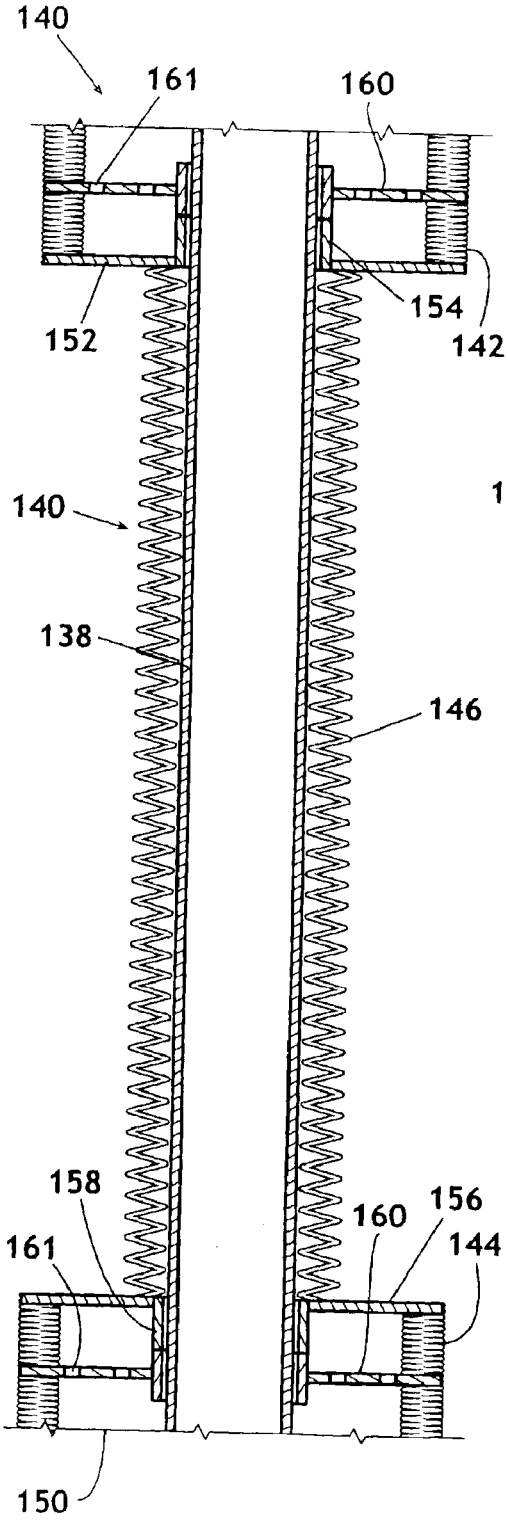
FIG. 3B is a schematic diagram of the second embodiment of the multi-diameter bellows shown in FIG. 1B shown in a fully retracted or minimum volume configuration.
Figure 3C:
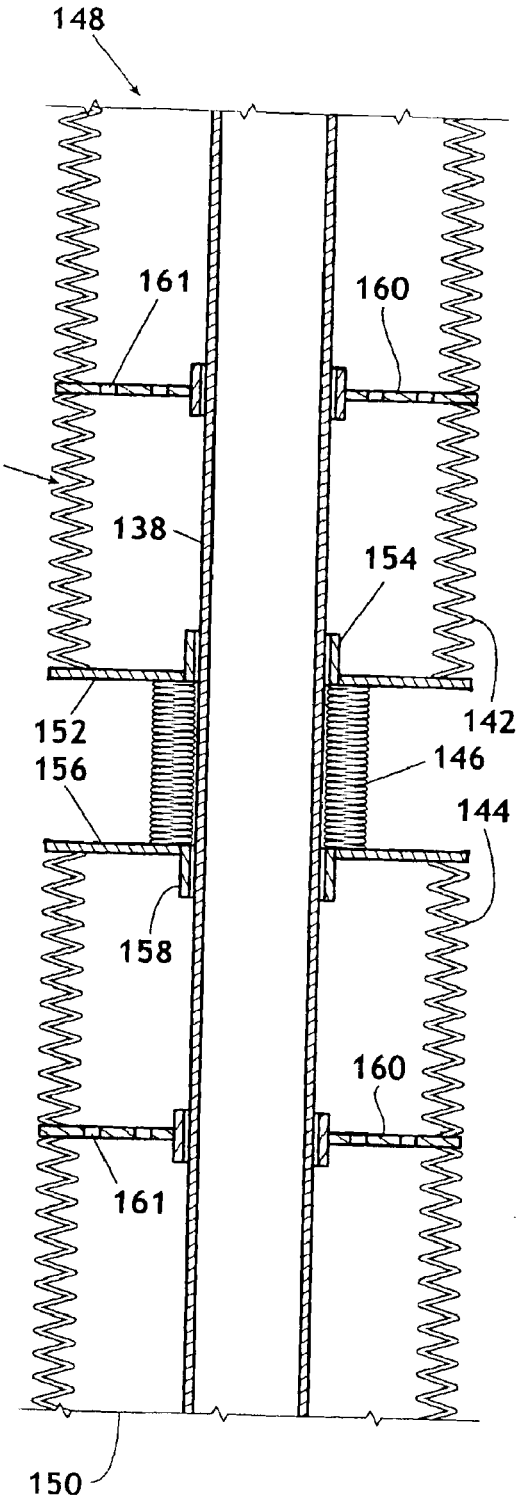
FIG. 3C is a schematic diagram of the second embodiment of the multi-diameter bellows shown in FIG. 1B shown in a fully expanded or maximum volume configuration.

Referring now to FIGS. 3A–3C, multi-diameter bellows 140 is shown in greater detail. An upper end 148 of the multi-diameter bellows 140 is affixed to the upper guide tube ring 132. A lower end 150 of the multi-diameter bellows 140 is affixed to the lower guide tube collar 114. Small diameter portion 146 is located between first large diameter portion 142 and second large diameter portion 144. A first end of the small diameter portion 146 engages the first large diameter portion 142 and is attached to a first coupling ring 152. First coupling ring 152 is attached to an upper end of the small diameter portion 146 and to a lower end of the first large diameter portion 142. The first coupling ring 152 preferably has a runner 154 located thereon for slidably engaging upper guide tube 138. A second end of the small diameter portion 146 is attached to the second large diameter portion 144 by a second coupling ring 156. Second coupling ring 156 is attached to a lower end of the small diameter portion 146 and to an upper end of second large diameter portion 144. Second coupling ring 156 is also preferably provided with a runner 158 for engaging the upper guide tube 138.

Multi-diameter bellows 140 also is preferably provided with a plurality of stabilizer disks 160 that have runners 162 provided on an inner diameter of the stabilizer disks 160 for slidably engaging upper guide tube 138. The stabilizer disks 160 communicate with an outer diameter of the first large diameter portion 142 and with an outer diameter of second large diameter portion 144. The stabilizer disks 160 preferably have a first side attached to a first segment of the first or second large diameter portions 142, 144 and a second side attached to a second segment of the first or second large diameter portions 142, 144. Stabilizer disks 160 are preferably provided with orifices 161 formed therein for permitting fluid to pass through the stabilizer disks 160 within the multi-diameter bellows 140.

Referring back to FIG. 1B, a sixth sleeve 164 is located in sleeve receptacle 122 of the upper head 116. An upper shaft seal 166 is located partially in the upper shaft seal receptacle 124 of the upper head 116. The upper shaft seal 166 is provided to prevent fluid migration along the upper shaft 104.

In practice, dielectric fluid surrounding motor 14 is heated by operation of motor 14 and/or by conducting heat from the well environment. As a result, the dielectric fluid expands and migrates through base 22 past first sleeve 28 and up lower shaft 26. The dielectric fluid may continue to migrate past second sleeve 36, through lower sleeve block 30 and into the annular space between the lower shaft 26 and the lower guide tube 64. Once dielectric fluid migrates into lower guide tube 64, the dielectric fluid passes through orifices 66 in lower guide tube 64 and into the small diameter portion 70 of the multi-diameter bellows 68. The dielectric fluid may then fill the small diameter portion 70 and large diameter portion 72 of the multi-diameter bellows 68.

Once the volume within the multi-diameter bellows 68 is full of fluid, then coupling ring 78 will propagate along lower guide tube 64 to increase the volume within the large diameter portion 72 until such time as the small diameter portion 70 is fully compressed. When the small diameter portion 70 is fully compressed, then the multi-diameter bellows 68 is at full capacity. Once the multi-diameter bellows 68 is at full capacity, the dielectric fluid will migrate through fluid passageway 52 in lower head 40 and out through check valve 54 into the lower bellows chamber 42. Once lower bellows chamber 42 becomes full, the fluid may continue to migrate upwardly through fluid bypass conduit 50, which allows the fluid to bypass lower shaft seal 88.

If necessary, the dielectric fluid will continue to migrate upwardly in the seal section 10 past coupling 90 and into the upper seal section 18 where fluid will migrate through upper base 100 past fourth sleeve 105 and through the annular space surrounding the upper shaft 104, and through fifth sleeve 112 in upper sleeve block 106. Dielectric fluid will then continue to migrate up through the annular space between the upper shaft 104 and the upper guide tube 138 where the fluid migrates out of upper guide tube 138 and into the multi-diameter bellows 140.

The dielectric fluid fills first large diameter portion 142, small diameter portion 146, and second large diameter portion 144 of multi-diameter bellows 140. Once the internal volume of the multi-diameter bellows 140 is completely full of fluid, first coupling ring 152 and second coupling ring 156 propagate along upper guide tube 138 toward one another, thereby expanding the volume of the first large diameter portion 142 and second large diameter portion 144 while compressing small diameter portion 146. As more fluid is added to the multi-diameter bellows 140, the first large diameter portion 142 and second large diameter portion 144 will continue to expand until small diameter portion 146 is fully compressed as shown in FIG. 3C, which illustrates the maximum volume configuration of multi-diameter bellows 140. Dielectric fluid will then migrate up through fluid passageway 126 and out through check valve 128 where the dielectric fluid will co-mingle with well fluids that are able to enter through perforations 130 in upper housing 102. Therefore, the pressure within the multi-diameter bellows 140 will be maintained in equilibrium with wellbore pressure.

Although two embodiments of multi-diameter bellows are shown, i.e. multi-diameter bellows 68 and multi-diameter bellows 140, located in a seal section 10 having a lower section 16 and an upper section 18, it should be understood that either the multi-diameter bellows 68 or 140 may be used in a seal section 10 having only a single section. Additionally, either multi-diameter bellows 68 or 140 may be used in a seal section 10 having three or more sections as desired. Although seal section 10 is shown for purposes of example having both a first embodiment 68 and a second embodiment 140, the seal section 10 could be used with two or more of the first embodiments 68 or second embodiments 140 as desired.

One advantage of the multi-diameter bellows 68, 140 is that the upper end 76, 148 and lower end 74, 150 are fixed, therefore the multi-diameter bellows 68, 140 occupy the same linear space of the seal section regardless of the volume of fluid located therein. The volume of the multi-diameter bellows 68, 140 is varied by movement of the coupling rings 78, 152 and 156.

An additional advantage of the end mounted multi-diameter bellows 68, 140 is that the bellows 68, 140 surround the shafts 26, 104. As a result, the multi-diameter bellows 68, 140 may be used above the pump motor 14 in the same manner as elastomeric bags have been used previously.

While the invention has been described with a certain degree of particularity, it is understood that the invention is not limited to the embodiment(s) set for herein for purposes of exemplification, but is to be limited only by the scope of the attached claim or claims, including the full range of equivalency to which each element thereof is entitled.

What is claimed is:

1. A bellows comprising:

a first fixed end;

a second fixed end;

a first collapsible section in communication with said first fixed end, said first collapsible section having a first cross-sectional area;

a second collapsible section in communication with said second fixed end, said second collapsible section having a second cross-sectional area;

a third collapsible section between said first collapsible section and said second collapsible section;

a first coupling member between said first collapsible section and said third collapsible section;

a second coupling member between said second collapsible section and said third collapsible section; and wherein a volume within the bellows is varied by movement of said first coupling member and said second coupling member towards one of said first fixed end and said second fixed end.

2. The bellows according to claim 1 wherein:

said first collapsible section, said second collapsible section, and said first coupling member surround a shaft of a submersible pump.

3. The bellows according to claim 2 wherein:

said first collapsible section and said second collapsible section are above a motor in a submersible pump.

4. The bellows according to claims 2 further comprising:

a stabilizer member in communication with one of said first collapsible section and said second collapsible section for suspending said one of said first collapsible section and said second collapsible section away from said shaft.

5. The bellows according to claim 4 wherein:

said stabilizer member slidingly engages a guide tube that surrounds said shaft.

6. The bellows according to claim 1 wherein:

said first cross sectional area of said first collapsible section and said second cross sectional area of said second collapsible section are equivalent.

7. The bellows according to claim 1 wherein:

said first coupling member is a ring.

8. The bellows according to claim 1 wherein:

said third collapsible section has a third cross-sectional area; and said third cross-sectional area is smaller than said first cross-sectional area and said second cross-sectional area.

9. A submersible pump comprising:

a motor in communication with a dielectric fluid;

a pump above said motor;

a seal section between said motor and said pump, said seal section defining a bellows chamber having a first end and a second end, said seal section defining an inlet for permitting well fluids to migrate into said seal section;

a shaft that communicates said motor with said pump, said shaft running through said bellows chamber in said seal section;

a bellows in said bellows chamber and surrounding said shaft, said bellows comprised of a first collapsible section and a second collapsible section, said bellows for maintaining said dielectric fluid within said bellows and for maintaining well fluids external to said bellows;

said first collapsible section in communication with said first end of said bellows chamber, said first collapsible section having a first cross-sectional area;

said second collapsible section in communication with said second end of said bellows chamber, said second collapsible section having a second cross-sectional area;

a first coupling member between said first collapsible section and said second collapsible section, said first coupling member surrounding said shaft; and wherein a volume within said bellows is varied by movement of said first coupling member towards one of said first end and said second end.

10. The submersible pump according to claim 9 further comprising:

a stabilizer member in communication with one of said first collapsible section and said second collapsible section for suspending one of said first collapsible section and said second collapsible section away from said shaft.

11. The submersible pump according to claim 10 wherein:

said stabilizer member slidingly engages a guide tube located around said shaft.

12. The submersible pump according to claim 9 further comprising:

a third collapsible section between said first collapsible section and said second collapsible section;

a second coupling member between said second collapsible section and said third collapsible section;

wherein said first coupling member is between said first collapsible section and said third collapsible section; and wherein a volume within said bellows is varied by movement of said first coupling member and said second coupling member towards one of said first end and said second end.

13. The submersible pump according to claim 9 wherein:

said first coupling member is a coupling ring.

14. The submersible pump according to claim 12 wherein:

said third collapsible section has a third cross sectional area; and wherein said first cross sectional area of said first collapsible section and said second cross sectional area of said second collapsible section are equivalent.

15. A method of operating a submersible pump in a wellbore comprising the steps of:

suspending a submersible pump within well fluid in a well bore;

migrating heated dielectric fluid upwardly above a motor of said submersible pump into a seal section of said submersible pump;

directing dielectric fluid into a bellows in said seal section, said bellows having a first fixed end and a second fixed end, said bellows comprised of a first collapsible section and a second collapsible section having a first coupling member and a second coupling member therebetween, said bellows further comprising a third collapsible section between said first collapsible section and said second collapsible section; and varying a volume of said bellows by moving at least one of said first coupling member and said second coupling member towards one of said first fixed end of said bellows and said second fixed end of said bellows.

16. The method according to claim 15 further comprising a step of:

maintaining said first collapsible section and said second collapsible section a desired distance away from a shaft in said submersible pump with a stabilizer member.

17. The method according to claim 15 wherein: said step of moving said first coupling member and said second coupling member comprises sliding said first coupling member and said second coupling member over a guide tube that surrounds a shaft in said submersible pump.

18. The method according to claim 15 wherein:

said first collapsible section has a first cross-sectional area;

said second collapsible section has a second cross-sectional area;

said third collapsible has a third cross-sectional area; and said third cross-sectional area is smaller than said first cross-sectional area and said second cross-sectional area.

* * * * *

UNITED STATES PATENT AND TRADEMARK OFFICE

CERTIFICATE OF CORRECTION

PATENT NO. : 6,851,935 B2
DATED : February 8, 2005
INVENTOR(S) : Merrill et al.

It is certified that error appears in the above-identified patent and that said Letters Patent is hereby corrected as shown below:

Column 4,
Line 49, replace "has" (2nd occurrence) with -- that --;

Column 6,
Line 67, replace "76" with -- 74 --;
Line 67, replace "74" with -- 76 --;

Column 7,
Line 14, replace "for" with -- forth --;

Column 10,
Line 16, after "collapsible" insert -- section --.

Signed and Sealed this

Twenty-fourth Day of May, 2005

JON W. DUDAS
*Director of the United States Patent and Trademark Office*